United States Patent [19]

Volk et al.

[11] Patent Number: 4,809,603

[45] Date of Patent: Mar. 7, 1989

[54] SETTING MECHANISM FOR SELECTIVE PRINTING MEMBER

[75] Inventors: Heinrich Volk, Beerfelden-Gammelsbach; Klaus Mikolajczyk, Hirschhorn, both of Fed. Rep. of Germany

[73] Assignee: Esselte Meto International GmbH, Fed. Rep. of Germany

[21] Appl. No.: 934,033

[22] Filed: Nov. 24, 1986

[30] Foreign Application Priority Data

Feb. 19, 1986 [DE] Fed. Rep. of Germany ..... 3605301

[51] Int. Cl.[4] ..... B41J 1/20

[52] U.S. Cl. ..... 101/111

[58] Field of Search ..... 101/110, 106–108, 101/99–101, 95–97, 111, 105

[56] References Cited

U.S. PATENT DOCUMENTS

| | | | |
|---|---|---|---|
| 4,149,460 | 4/1979 | Sato | 101/110 |
| 4,233,896 | 11/1980 | Hamisch, Jr. | 101/110 |
| 4,284,004 | 8/1981 | Sato | 101/111 |
| 4,331,076 | 5/1982 | Sato | 101/110 |
| 4,586,432 | 5/1986 | Volk | 101/111 |

FOREIGN PATENT DOCUMENTS

| | | | |
|---|---|---|---|
| 163592 | 10/1982 | Japan | 101/110 |

*Primary Examiner*—Clifford D. Crowder
*Attorney, Agent, or Firm*—Gerald J. Ferguson, Jr.

[57] ABSTRACT

A printing mechanism comprises a housing (12, 14) in which a plurality of coaxially disposed setting wheels (16) are arranged with which type carriers (20) carrying printing types (22) are in a drive connection and can be brought into predetermined setting positions. A setting shaft (42) extends through center openings disposed in the hub region of the setting wheels (16), the setting shaft (42) being mounted rotatably and axially displaceably in a wall (15) of the housing. The shaft carries at one end at least one driver (36, 38) which by axial displacement of the setting shaft (42) is adapted to be brought into engagement with radial recesses (47) formed in the hub region of the setting wheels (16). At its other end the setting shaft (42) carries an actuating knob (48). At least two detent elements are provided for arresting the setting wheels (16) on rotation thereof and holding the setting wheels (16) in their rest position. The one detent element (70–76, 90) is so formed that it is in operative connection with the particular setting wheel (**16*a*) selected and in addition at the most with the setting wheels (16) arranged between the selected setting wheel (16*a*) and the other end of the setting shaft (42**).

13 Claims, 8 Drawing Sheets

SETTING MECHANISM FOR SELECTIVE PRINTING MEMBER

Figure 1:
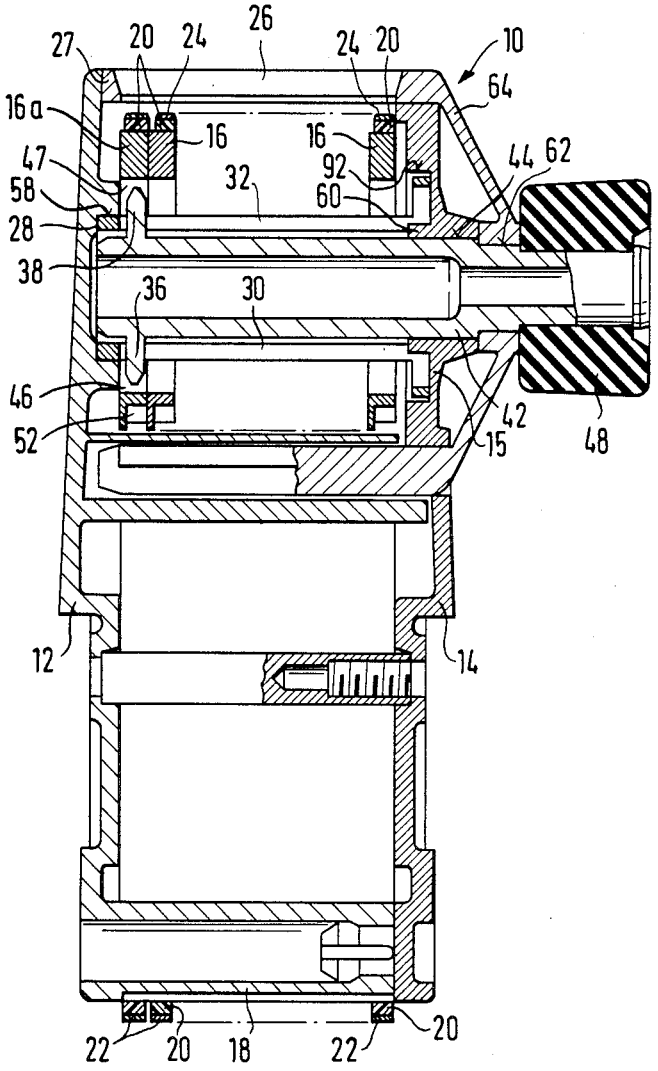

The invention relates to a printing mechanism comprising a housing, a plurality of coaxially disposed setting wheels with which type carriers carrying printing types are in drive connection and can be brought into predetermined setting positions, a setting shaft which extends through centre openings disposed in the hub region of the setting wheels and which is mounted rotatably and axially displaceably in a wall of the housing and at one end carries at least one driver adapted by axial displacement of the setting shaft to be brought into engagement with radial recesses disposed in the hub region of the setting wheels and which at its other end carries an actuating knob, and at least two detent means for arresting the setting wheels on rotation thereof and for holding the setting wheels in their rest position.

DE-PS No. 3,406,822 discloses such a printing mechanism. In this known printing mechanism the type wheels are individual endless bands carrying printing types at their outer peripheral face. These bands are led round a portion of the periphery of the setting wheels and round a deflection edge extending in parallel spaced relationship to the axis of the setting wheels. In each setting position of the bands a printing type is located in the region of the deflection edge and in the printing operation this printing type is used. To obtain an exact setting of the particular printing type selected it is desirable for the operator on turning the setting wheels and thus moving the bands to have to overcome a certain detent force each time which offers a resistance to the turning of the associated setting wheel. By overcoming the detent force the operator can feel when the printing types are advanced from one setting position to the next. The deflection edge provided in the known printing mechanism around which the printing bands used as type carriers are led represents a first means for generating said detent force. For the printing bands are not made uniformly thick; the individual fields carrying the printing types at the printing band outer side are separated from each other by grooves so that there is a thin band region between every two thick band regions. When by turning an actuating knob a printing band is led round the deflection edge the operator can feel every time a transition takes place from a thin region to a thick region and vice versa. Before a thick region of the printing band slides round the deflection edge the operator must always apply a slightly higher turning moment and this enables the operator to feel when a printing band has been adjusted through one printing type.

In the known printing mechanism the detent force is intensified with the aid of a second detent means which generates the detent force by means of an elastically yieldable rubber strip and a helical spring which are so arranged that the helical spring is pressed by the rubber strip into engagement with the outer peripheral face of the setting wheels. Since in the outer peripheral faces of the setting wheels transport recesses are disposed into which drive teeth on the bands forming the type carriers engage, the helical spring engages in the region of each setting wheel not enclosed by the bands into the transport recesses so that on turning of a setting wheel said spring must first be pressed out of such a recess before the setting wheel can be turned. Under the action of the rubber strip the spring then automatically again engages into the next transport recess. The force effecting the expulsion from the transport recess is the detent force which can be felt by the operator.

The detent means used in the known printing mechanism consists of two mechanical parts which in the assembly of the printing mechanism must be individually handled and inserted into the printing mechanism housing. It has been found that although the detent force can be felt by the operator the detectability of the detent positions still needs to be made clearer.

The problem underlying the invention is thus to further develop a printing mechanism of the type outlined at the beginning in such a manner that in spite of a reduced number of components it provides exactly defined setting positions easily felt by the operator in the setting operation.

According to the invention this problem is solved in that one detent means is constructed such that it is in operative connection with the particular setting wheel selected and in addition at the most with the setting wheels arranged between the selected setting wheel and the other end of the setting shaft.

In the printing mechanism according to the invention the one detent means opposing the turning of a setting wheel with a force which can be felt by the operator acts in every case on the setting wheel which is the one to be adjusted. In addition, it can also cooperate with the setting wheels which lie between the particular setting wheel to be adjusted and the end of the setting shaft carrying the actuating knob. Because of this configuration the detent means can have a simple construction because it need no longer act on all the setting wheels simultaneously as in the known printing mechanism.

An advantageous further development of the invention in which the setting wheels are mounted rotatably coaxially on a sleeve and the setting shaft is axially displaceable in the sleeve and rotatable therewith, the at least one driver projecting through a slot associated therewith and extending in axial direction in the sleeve outwardly into the recesses of the particular setting wheel selected, is characterized in that the one detent means is disposed at one end of the sleeve and comprises at least one resilient detent member and that in the housing wall facing the one end of the sleeve detent recesses associated with the setting positions of the type carriers are provided for engagement by the at least one detent member.

In the printing mechanism according to this further development the sleeve carrying the setting wheels and the detent means defining the setting positions of the setting wheels form a single component and this has favourable effects on the assembly time of the printing mechanism. By the cooperation of the resilient detent member with detent recesses exactly defined detent positions are obtained and thus also exactly defined setting positions of the individual setting wheels and it is thus ensured that the operator conducting the setting operation reliably brings the particular type carrier to be set into an exact setting position. The exact defining of the setting position is however a necessary requirement for obtaining a satisfactory imprint. The further development of the printing mechanism according to the invention thus also contributes to obtaining good print images or imprints.

Advantageous further developments of the invention are characterized in the claims. A further development facilitates production of the printing mechanism components, i.e. of the sleeves with the integrally formed detent member and the housing member with the detent recesses, in simply shaped injection molds, because the specific configuration of these components does not require any undercuttings or other shapes difficult to produce with injection molding.

An advantageous further development ensures a reliable location of the sleeve so that no distortion or tilting can occur when the sleeve is turned when forming a setting operation.

Further developments make it possible to arrange four detent members symmetrically with the sleeve axis so that on rotation of the sleeve a symmetrical load also acts thereon. This contributes to the sleeve remaining easy to turn and not being radially displaced under the action of the detent forces arising on rotation. A further development provides a sleeve which in spite of providing two slots is stable because the slots are bridged by the connecting points of the finger ends. The insertion into each other of the setting shaft and sleeve is easily effected because the connecting points extend so far above the outer peripheral face of the sleeve that they do not obstruct the drivers on insertion into the sleeve.

A further development is suitable for use in a printing mechanism in which the setting wheels are not mounted as in the previously described further development on a sleeve but in a bearing shell. By providing a single component, i.e. the bush, provided with the detent member, in the housing wall and by forming detent recesses in the housing wall an operative connection can be established between the detent means and the setting shaft by which the operator can exactly feel when a type carrier has been advanced by one position. A further development of the invention results from a slight modification of the slit eyes enclosing the setting shaft on the side of the actuating knob; it does not require any additional components for the implementation of the detent means.

A further development requires no separate components for obtaining the desired detent effect; it can be implemented by simple modification of the position of the pin and possibly by a modification of the pin on the side facing the setting wheels.

Figure 2:
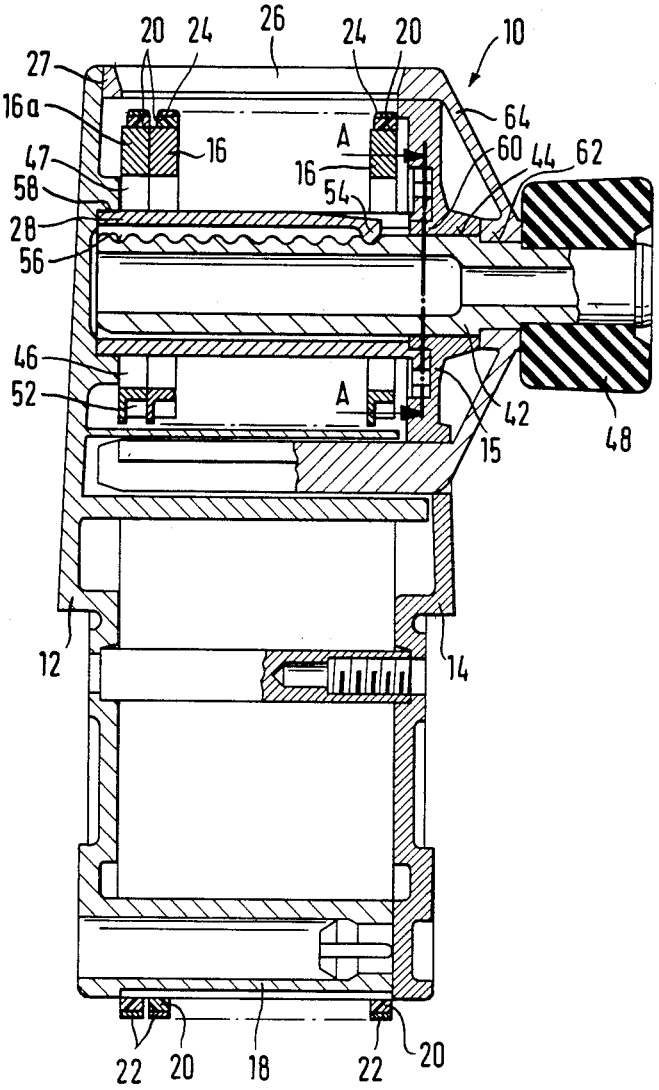
Figure 3:
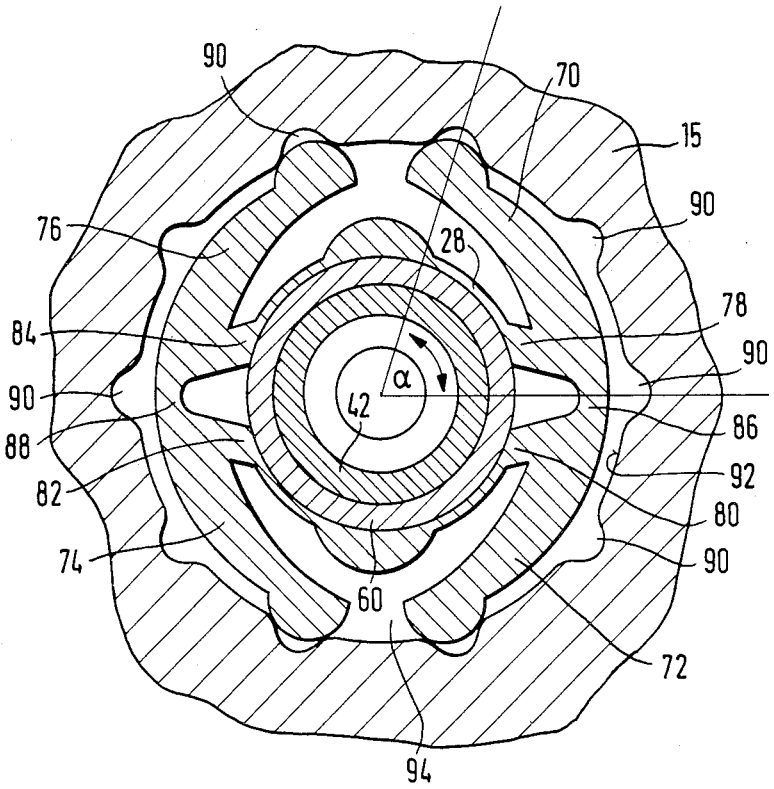
Figure 4:
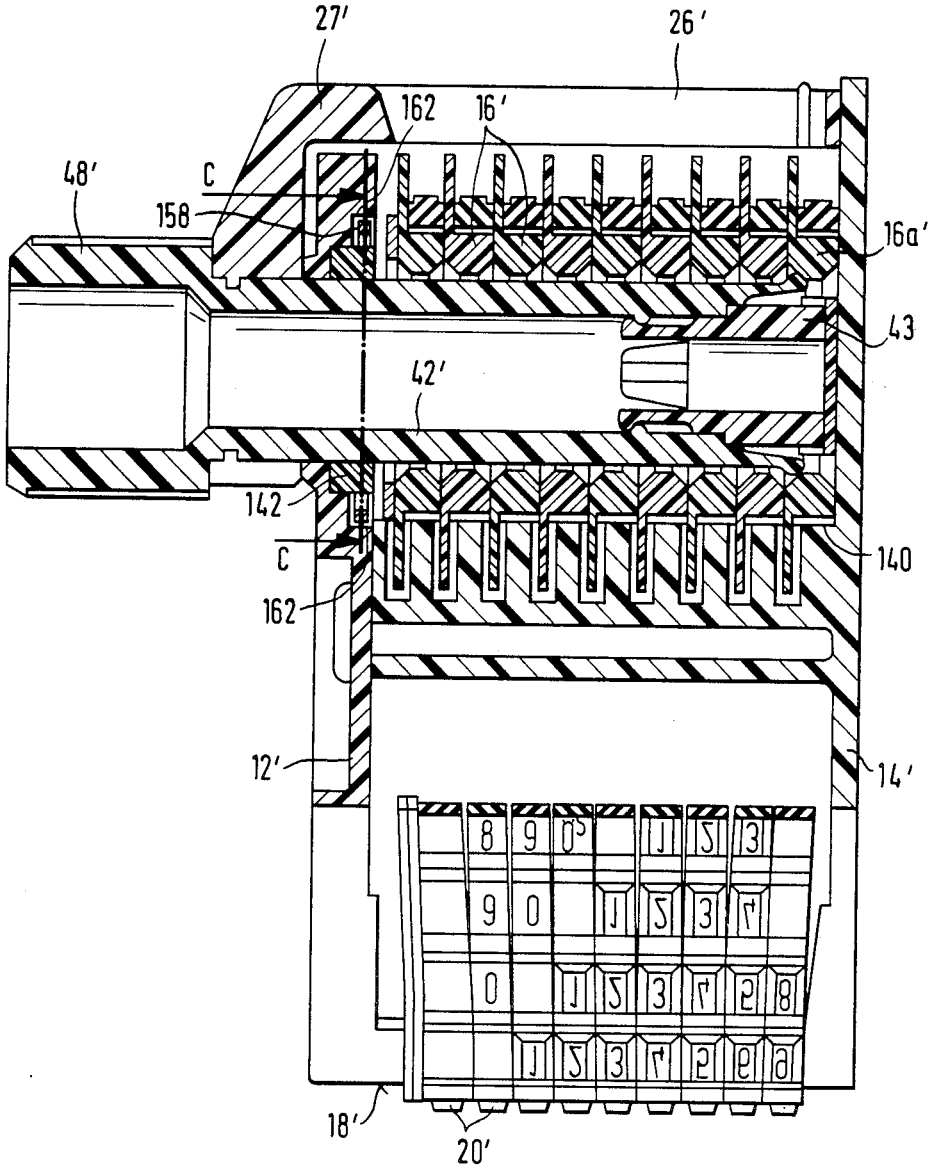
Figure 5:
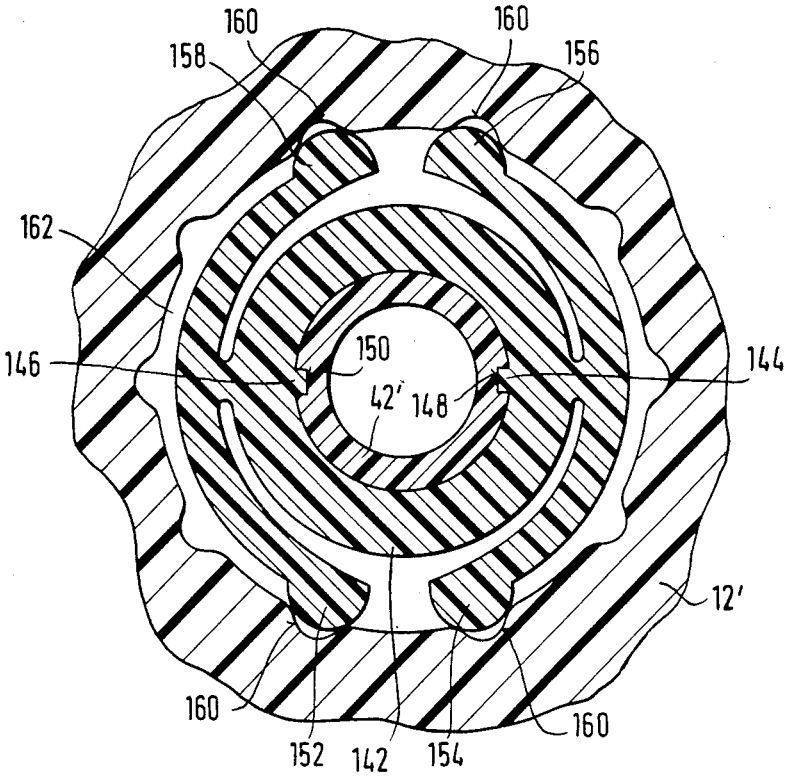
Figure 6:
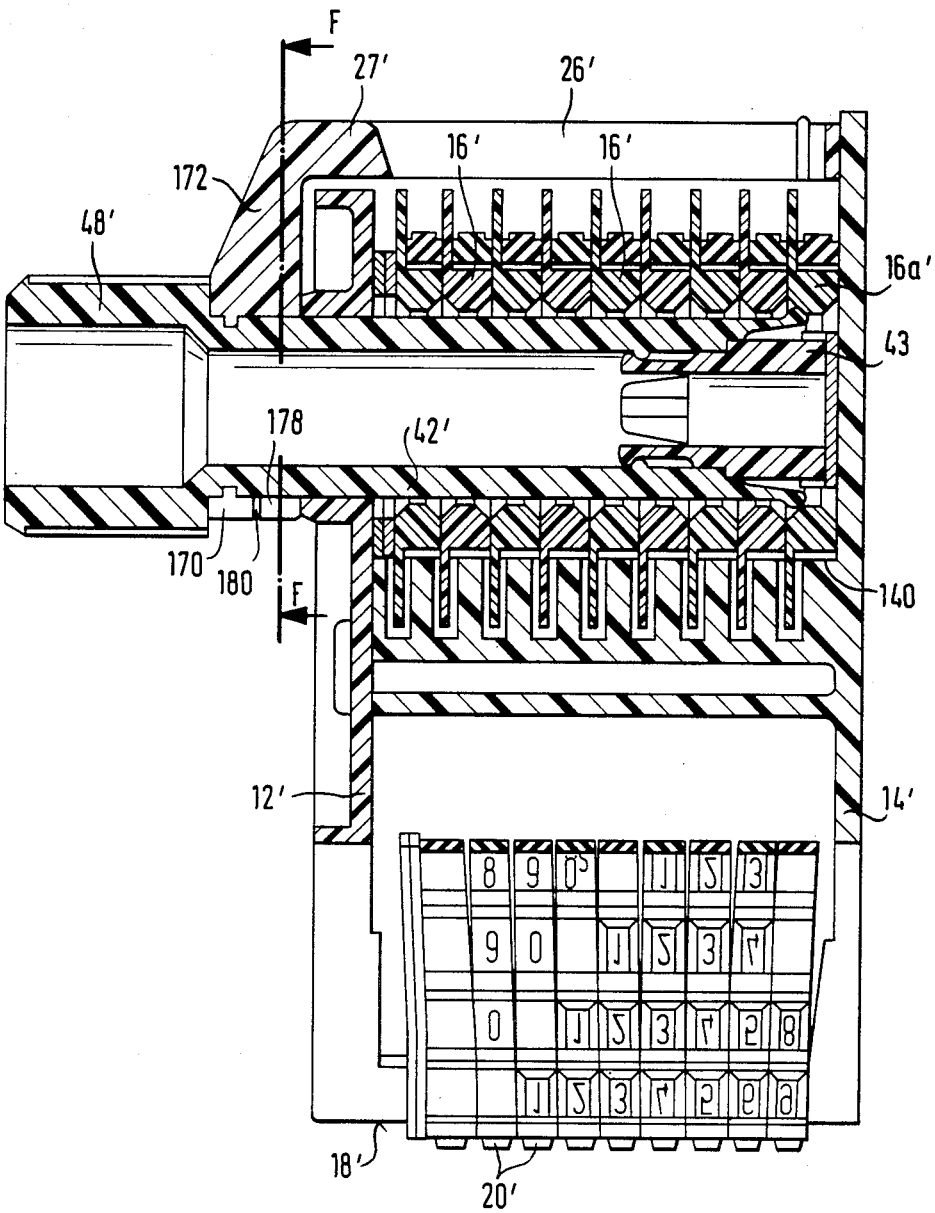
Figure 7:
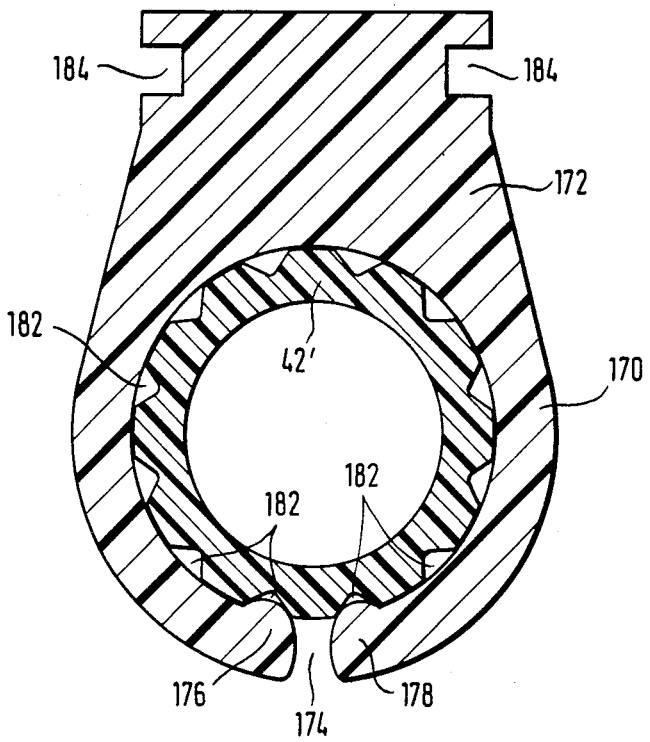
Figures 8, 9:
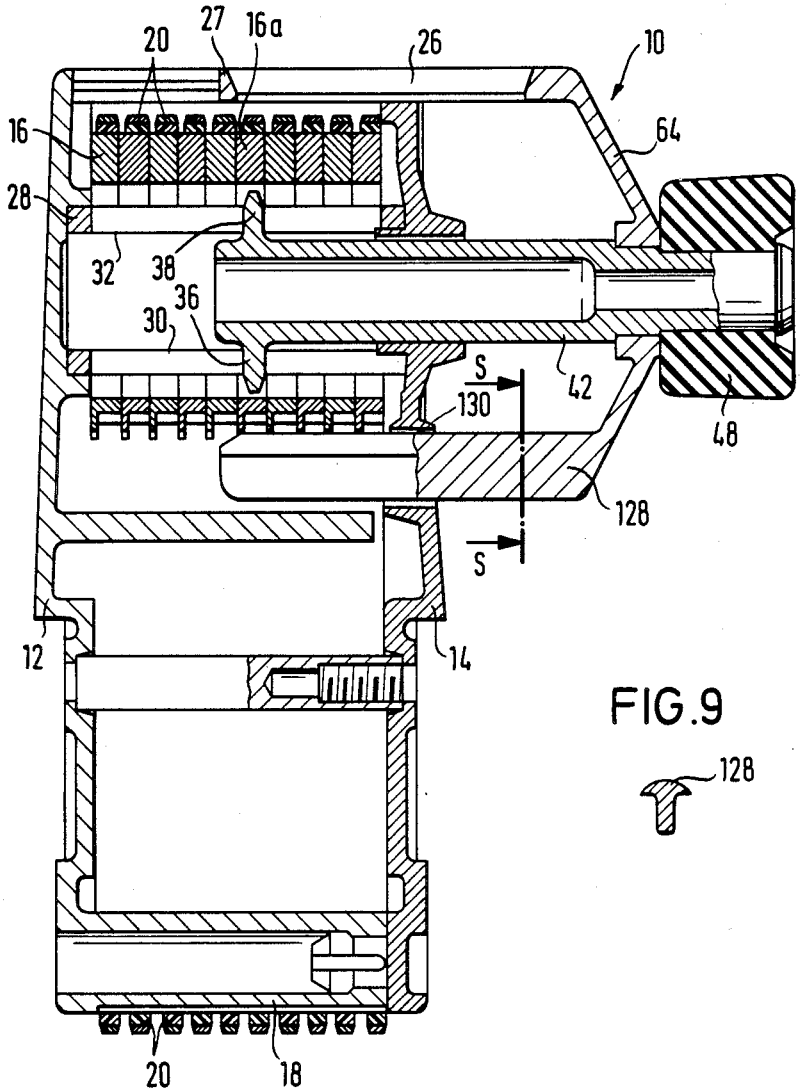

An example of embodiment of the invention will now be explained by way of example with the aid of the drawings, wherein:

FIG. 1 is a section of the printing mechanism according to the invention in which the setting shaft and the sleeve are turned so that the two drivers disposed on the setting shaft are visible, FIG. 2 is a section similar to FIG. 1, the setting shaft and the sleeve being turned however through 90° with respect to the illustration of FIG. 1, FIG. 3 is an enlarged partial section along the line A—A of FIG. 2, FIG. 4 is a partially sectioned view of a printing mechanism according to a further embodiment of the invention, FIG. 5 is a section along the line C—C of FIG. 4, FIG. 6 is a view of a further example of embodiment of the invention, FIG. 7 is a section along the line F—F of FIG. 6, FIG. 8 is a section of a further embodiment of a printing mechanism and FIG. 9 is a section along the line S—S of FIG. 8.

The printing mechanism 10 illustrated in FIG. 1 comprises a printing mechanism housing which is made up of two housing halves 12 and 14 and in which a plurality of printing bands 20 are accommodated which are arranged parallel adjacent each other and led round setting wheels 16 and a deflection edge 18. The printing bands 20 carry on one half of their outer peripheral face printing types 22 and on the other half display types 24. The association of the printing types 22 with the display types 24 is such that printing types 22 which happen to be in the printing position at the deflection edge 18 as in FIG. 1 and display types 24 which are visible through a window 26 disposed at the housing upper side and surrounded by a frame 27 each represent the same number, the same letter or the like. This means that it can be seen in the window 26 at the housing upper side which characters can be printed on a record carrier with the printing types 22 disposed at the bottom at the deflection edge.

As already mentioned, the printing bands 20 are led round setting wheels 16 which are rotatably mounted on a sleeve 28. The sectional view of FIG. 1 shows that in the sleeve 28 two slots 3,, 32 are formed which are closed at the sleeve end lying on the left in FIG. 1. Through said slots two drivers or dogs 36, 38 disposed on a setting shaft 42 engage. The setting shaft 42 is mounted rotatably and axially displaceably in a bearing passage 44 in the housing half 14. By displacement of the setting shaft 42 in the axial direction, by engagement of the dogs or drivers 36, 38 in recesses in the hub regions of the setting wheels 16 said shaft can be brought into drive connection with said wheels. In FIG. 1 only two recesses 46, 47 are shown. The engagement of the drivers 36, 38 in the recesses 46, 47 of a setting wheel 16 can be seen.

At the end of the setting shaft 42 projecting out of the housing an actuating knob 48 is disposed with the aid of which the shaft can firstly be axially displaced and secondly turned. By the axial displacement of the setting shaft 42 the drivers 36, 38 disposed thereon are first brought into engagement with the recesses 46, 47 of a setting wheel 16 to be adjusted and by turning the setting shaft 42 the printing band 20 led round the outer periphery thereof is then moved until a desired printing type 22 is located in the printing position beneath the deflection edge 18. As already mentioned the particular position of the printing types 22 can be checked in the window 26 disposed at the top of the housing. To obtain a drive connection between the printing bands 20 and the setting wheels 16 the printing bands 20 have at their inner face teeth which are not illustrated and which engage in recesses 52 in the outer peripheral faces of the setting wheels 16.

To ensure an exact alignment of the plane of the drivers 36, 38 with the plane of the particular setting wheel 16 to be adjusted a detent mechanism which can be seen in FIG. 2 is provided and ensures that the setting shaft 42 on axial displacement thereof always engages in a manner clearly felt by the operator into positions in which a clear drive connection is established with only one setting wheel 16 to be adjusted. This detent mechanism includes a resilient detent finger 54 which is integrally formed on the sleeve 28 and which projects at the sleeve inner face radially inwardly and engages in detent recesses 56 which are formed in a region of the outer peripheral face of the setting shaft 42.

A detent recess 56 is provided for each of the setting wheels 16 mounted on the sleeve 28. If in the arrangement of the individual parts illustrated in FIG. 2 in which the setting shaft 42 is in engagement with the setting wheel 16 lying furthest to the left, the setting shaft is moved to the right so that for example it comes into engagement with the next setting wheel 16, firstly the detent force exerted by the detent finger 54 on the setting shaft 42 must be overcome when said finger is moved out of the associated detent recess 56 upwardly in the illustration of FIG. 2; subsequently said finger can drop into the next detent recess 56 and this takes place exactly when the setting shaft 42 is in engagement with the second setting wheel 16 from the left.

Since the slit sleeve 28 serves as bearing shaft for the setting wheels 16 particular attention must be paid to the locating and mounting of said sleeve in the printing mechanism. Firstly, for mounting the setting wheels 16 the sleeve 28 must have an outer diameter which is as constant as possible and secondly it must also have an exactly defined inner diameter so that the setting shaft 42 can be easily axially displaced without jamming. The sleeve 28 is disposed on the one side, the left side in FIG. 1, in a circular recess 58. Since the slits 30, 32 at this side of the sleeve 28 are closed it suffices at this point to mount the sleeve 28 at its outer side. At the other side, the right side in FIG. 1, the sleeve 28 is mounted on a hub 60 which is formed on the housing portion 14. The hub 60 ensures that the sleeve 28 at the associated end has the necessary stability for mounting the setting wheels 16.

As apparent from FIGS. 1 and 2 in the portion immediately adjoining the actuating knob 48 the setting shaft 42 extends through a passage 62 which is formed on a conical cap 64. This cap has among other things the purpose of ensuring a smooth covering of the upper part of the printing mechanism 10. It also however carries a frame 27 which surrounds the window 26 and which is mounted displaceably at the top of the housing. When the setting shaft 42 is axially displaced the frame 27 moves together with the window 26, the end of the display window lying on the left in FIG. 1 lying in each case in the plane of the setting wheel 16 with which the setting shaft 42 is in engagement and which consequently can be adjusted. By observing the left end of the window 26 the operator thus knows in each axial position of the setting shaft 42 which particular printing band can be brought into the desired position.

To ensure that the operator on turning the setting wheels and thus setting the printing bands always continues the individual setting operations until a printing type 22 is located exactly in the printing position at the deflection edge 18 a further detent mechanism is provided which facilitates the exact setting for the operator. This detent mechanism is made up of two parts, that is a part formed on the sleeve and a part disposed in the wall of the housing half 14. As apparent from FIGS. 1 and 2 this detent mechanism is at the end of the sleeve 28 on the right in the illustration. The exact structure will be apparent from the enlarged sectional view of FIG. 3.

As the enlarged partial section taken along the line A—A of FIG. 2 and shown in FIG. 3 indicates the part of the detent mechanism formed on the sleeve comprises as detent members four fingers 70, 72, 74, 76 which are disposed symmetrically about the axis of the sleeve 28 and extend substantially concentric to said sleeve 28 and are formed at one end in each case on the sleeve by means of a connecting web 78, 80, 82 and 84 respectively. The finger ends formed on the sleeve 28 via the webs 78, 80, 82, 84 are joined together in pairs at connection points 86, 88, said connection points 86, 88 lying as shown in FIG. 1 in the plane defined by the two slots 30, 32 so that they bridge the slots at the end lying on the right in the illustration of FIGS. 1 and 2 and stabilize the sleeve at said end in spite of the presence of the slots.

The ends of the fingers 70, 72, 74, 76 remote from the connection points are formed like fingertips and engage in grooves 90 which extend axially with respect to the sleeve 28 and which are disposed in the radially outer peripheral face 92 of an annular groove 94 in the housing wall 15 concentrically surrounding the sleeve 28.

As apparent from FIG. 3 the fingers 70, 72, 74, 76 extend in each case in the peripheral direction from the associated connection point over an angle $\alpha$ of about 70° to 80°.

The connection points 86, 88 of the ends of the fingers 70, 72 and 74, 76 respectively are radially spaced from the outer peripheral face of the sleeve 28 a distance great enough for the setting shaft 42 with the drivers 36, 38 disposed thereon to be insertable in assembly in to the sleeve 28 without the drivers 36, 38 striking against the connection points 86, 88. This means in other words that the radial spacing of the connection points 86, 88 from the outer peripheral face of the sleeve 28 is at least as great as the extent which the drivers 36, 38 of the setting shaft 28 project radially outwardly through the associated slots 30, 32.

Due to the arrangement of the individual fingers 70, 72, 74, 76 shown in FIG. 3 engagement of the finger ends in the grooves 90 resists with an exactly defined detent force a rotation of the setting shaft 42 and the sleeve 28 in either direction. The relative position of the parts with respect to each other shown in FIG. 3 is one of the positions in which the printing bands 20 assume a predetermined setting position, i.e. a position in which printing types 22 are disposed beneath the deflection edge 18 in the printing position. When a printing band 20 is to be adjusted by turning the setting shaft 42 the latter must first be brought by axial displacement into a position such that the drivers 36, 38 are disposed in the plane of the setting wheel 16 about which the printing band 20 to be adjusted is led. When the setting shaft 42 is turned in the position of FIG. 1 the printing band 20 lying furthest to the left in this illustration can be adjusted. When the operator starts turning the setting shaft 42 the ends of the fingers 70, 72, 74, 76 engaging in the grooves 90 are first pressed radially inwardly against the spring force exerted by the fingers, whereupon they slide along the radial outer peripheral face 92 of the annular groove 94 until finally they drop into the respective next groove 90. The associated printing band 20 has thus been advanced one step. This operation is continued until the desired printing type 22 assumes the setting position beneath the deflection edge 18. The pressing of the ends of the fingers 70, 72, 74, 76 out of the grooves 90 and the dropping back into the next grooves 90 can be clearly felt by the operator and due to the simultaneous engagement in four grooves 90 exactly defined setting positions result and this has favourable effects on the exact locating of the printing types 22 beneath the deflection edge 18 and thus also on the imprint to be produced.

Since the fingers 70, 72, 74, 76 and the sleeve 28 are made integrally to implement the detent mechanism described no additional loose components have to be used and this reduces the assembly time of the printing mechanism. The specific configuration of the detent mechanism according to FIG. 3 and in particular the direct association of the position of the grooves with the finally desired setting positions of the printing bands 20 is of particular advantage in the assembly of the printing mechanism. For assembling the printing mechanism firstly all the setting wheels 16 can be inserted in a stack with the printing bands 20 already led round them into the housing half 12. The printing bands 20 can be brought into a position such that in each case a printing type 22 is disposed exactly in the printing position beneath the deflection edge 18. This means that each printing band 20 assumes one of its desired setting positions. The setting shaft 42 can be inserted from the left in the illustration of FIG. 1 or FIG. 2 through the bearing passage 44, whereupon the sleeve 28 is pushed from the left over the setting shaft 42 until the detent fingers lie in the region of the section plane A—A of FIG. 2. The sleeve is then mounted at its right end on the hub 60. After attaching the cap 64 and the actuating knob 48 the housing half 14 can then be assembled with the housing half 12, the sleeve 28 being inserted with the drivers 36, 38 projecting therefrom into the inner region of the setting wheels 16. Since the printing bands 20 and thus also the setting wheels 16 are in predetermined setting positions which are exactly associated with the positions of the grooves 90 defining the respective position of the drivers 36, 38, said drivers also assume with certainty positions such that on insertion into the stack of setting wheels 16 they engage into the recesses 47 disposed in the hub region of the setting wheels 16. A particular rotation of the setting shaft 42 with the objective of permitting an insertion of the sleeve 28 and the setting shaft 42 into the setting wheel stack is thus not necessary.

In the embodiment described the detent means is always in operative engagement only with the particular setting wheel to be adjusted, into the recesses 47 of which disposed in the hub region the drivers 36, 38 engage.

The printing mechanism illustrated in FIG. 4 differs from the printing mechanism of FIG. 1 in so far as the setting wheels 16' are not supported on a sleeve but on a bearing shell 140 in the printing mechanism housing. The components of the printing mechanism of FIG. 4 which correspond to components of the embodiments of FIGS. 1 and 2 are designated by the same reference numerals amplified by an apostrophe. The setting shaft 42' extends axially with respect to the setting wheels 16' and comprises at its end a component 43 which is in connection with said shaft via a snap-action connection and which carries drivers similar to the drivers 36, 38 of FIGS. 1 and 2. These drivers are not apparent in the illustration of FIG. 4 because they do not lie in the plane of the drawing. Just like the drivers 36, 38 they cooperate with recesses in the inner peripheral faces of the setting wheels 16' and by axial displacement of the setting shaft 42' the drivers can be brought into a drive connection with a selected setting wheel 16', whereupon the selected setting wheel can then be brought into a desired setting position by turning the setting shaft 42' by means of the actuating knob 48'. As in the example of embodiment previously described by this turning the printing types disposed on the printing bands 20' can be brought into the printing position beneath the deflection edge 18'.

To produce a detent means which opposes turning of the selected setting wheel with an additional detent force a bush 142 is disposed in the housing wall 12' and surrounds the setting shaft 42' in the manner of a bearing shell. As apparent from FIG. 5 the bush 142 comprises in its inner peripheral face two projections 144, 146 which engage into corresponding grooves 148, 150 in the outer peripheral face of the setting shaft 42'. These grooves extend over the entire length of the setting shaft 42' so that the setting shaft can be displaced axially relatively to the bush 142; a relative rotation of the bush 142 with respect to the setting shaft 42' is however not possible.

The bush 142 carries according to FIG. 5 at its outer peripheral face four fingers 152, 154, 156, 158 which are connected together in pairs at one end. The cantilever other ends of said fingers are formed like fingertips and engage in grooves 160 which are formed in a radially inwardly directed face of a bore 162 in the housing wall 12' receiving the bush 142 and the fingers 152–158. These grooves 160 are associated in their position with the setting positions of the type carrier so that whenever the four fingertip-like ends of the fingers 152–158 lie in corresponding grooves 160 the particular setting wheel in drive connection with the setting shaft via the drivers, not illustrated, assumes a position such that a printing type is exactly located in the printing position beneath the deflection edge 18'. On turning the setting shaft from one setting position to the next the operator feels a pronounced detent force which enables him to set the printing bands exactly.

As in the example previously described it should be observed here that the detent means formed by the bush 142 and the grooves 160 via the setting shaft 42' is always only in operative connection with the particular setting wheel which is to be adjusted.

FIG. 6 illustrates a further embodiment of the invention, the same reference numerals as in FIG. 4 being used for the same parts. In this example of embodiment the detent means is not disposed in the housing wall 12' but in a slit eye 170 which surrounds the setting shaft on the side of the actuating knob and which is joined via a web 172 to a window frame 27' which carries the window already described in conjunction with FIGS. 1 and 2. The eye engaging round the setting shaft 42' comprises at its end lying at the bottom in FIG. 6 an axially extending slot 174 which is best seen in FIG. 7. The eye is also divided by a radially extending slot 180 at least in its half lying at the bottom in FIG. 6 and the opposing ends of the eye are formed on one side of the radially extending slot 180 in the manner of fingertips to define detent fingers 176, 178 and engage in grooves 182 which are disposed in the region of the eye 170 in the outer peripheral face of the setting shaft 42'. The positions of the grooves 182 are associated with the setting positions of the printing bands 20 so that whenever the setting shaft assumes a position as in FIG. 7 in which the fingertip-like ends of the detent fingers 176, 178 engage into two grooves 182 a printing type on the printing band led round the selected setting wheel 16' exactly assumes a printing position beneath the deflection edge 18'. On each rotation of the setting shaft the detent fingers 176, 178 produce on passing from one groove 182 to the next a detent force which can be clearly felt by the operator and which makes it substantially easier to the operator to set the printing bands.

The grooves 184 apparent at the upper end of the web 172 in FIG. 4 serve to guide the window frame 27' in a part, not illustrated, of the printing mechanism housing.

As in the previously described examples of embodiment the detent means with the detent fingers 176, 178 and the grooves 182 are in operative connection via the setting shaft 42' in each case only with the particular setting wheel 16' which can be adjusted due to the axial position of the setting shaft 42'.

A further embodiment of the invention is illustrated in FIGS. 8 and 9. The basic structure of the printing mechanism corresponds to the structure of the printing mechanism of FIGS. 1 to 3, the same reference numerals also being used for identical parts. In this embodiment the pin 128 disposed at the lower end of the conical cap 64 is used as detent means acting additionally to the detent means formed by the deflection edge 18. The pin 128 extends parallel to the axis of the setting shaft 42 and extends through a passage 130 in the housing half 14. The distance between the pin 128 and the axis of the setting shaft 42 is so dimensioned that the pin 128 comes into engagement with recesses in the outer peripheral face of the setting wheels 16 which serve to establish the drive connection with the printing bands 20. In FIG. 8 to illustrate the working principle of the detent means formed by the pin 128 the setting shaft 42 is moved to the right so that the drivers 36, 38 of the setting shaft are in engagement with the setting wheel **16*a*. In this position of the setting shaft 42 the pin 128 engages into the recesses at the outer peripheral face of the setting wheel 16*a* so that the pin 128 opposes turning of said setting wheel 16*a* with a detent force which the operator can feel. Simultaneously, the pin 128 also engages into the recesses at the outer peripheral faces of the setting wheels lying on the right of the setting wheel 16*a*. To enable the setting wheel 16*a* to be turned the operator must overcome the detent force generated by the pin 128 and this can be done by deflecting the pin 128 downwardly in the illustration of FIG. 8. The pin can readily execute this deflection movement because its connection to the conical cap 64 is adequately resilient. The deflection movement downwardly is also permitted by the passage 130 having a larger diameter than the pin 128. This embodiment has the advantage that when the setting shaft 42 is completely inserted, i.e. when the printing mechanism is in the setting in which it is used for printing, the pin ' 128 is in operative engagement with the outer peripheral faces of all the setting wheels. As a result, the pin 128 in this position of the setting wheels 42** exerts a retaining action on all the setting wheels and this opposes any unintentional turning of the printing bands.

FIG. 9 illustrates a section along the line S—S of FIG. 8 which show that the pin 128 is made mushroom-shaped in cross-section and with its round cap cooperates with the outer peripheral faces of the setting wheels 16. The web attached to the round cap stiffens the pin 128 so that it can generate the necessary detent force in desired manner.

What is claimed:

1. Printing mechanism comprising a housing, a plurality of coaxially disposed setting wheels with which type carriers carrying printing types are in drive connection and can be brought into predetermined setting positions, a setting shaft which extends through center openings disposed in the hub region of the setting wheels and which is mounted rotatably and axially displaceably in a wall of the housing and at one end carries at least one driver adapted by axial displacement of the setting shaft to be brought into engagement with radial recesses disposed in the hub region of the setting wheels and which at its other end carries an actuating knob, and at least two detent means for arresting the setting wheels on rotation thereof and for holding the setting wheels in their rest position, characterized in that one of said two detent means is in indirect mechanical connection with the particular setting wheel selected, in which the setting wheels are mounted rotatably coaxially on a sleeve and the setting shaft is axially displaceable in the sleeve and rotatable therewith, the at least one driver projecting through a slot associated therewith and extending in the axial direction in the sleeve outwardly into the recesses of the particular setting wheel selected, characterized in that the one detent means is disposed at one end of the sleeve and comprises at least one resilient detent member and that in the housing wall facing the one end of the sleeve detent recesses associated with the setting positions of the type carriers are provided for engagement by the at least one detent member.

2. Printing mechanism according to claim 1, characterized in that the at least one detent member is integrally formed on the sleeve in such a manner that said member generates a radially outwardly directed detent force, and that the detent recesses are grooves extending axially with respect to the sleeve in the radially outer peripheral face of an annular groove extending concentrically to the sleeve in the housing wall (15).

3. Printing mechanism according to claim 2, characterized in that the radial inner peripheral face of the annular groove forms a hub on which the one end of the sleeve is rotatably mounted.

4. Printing mechanism according to claim 2 or 3, characterized in that at the one end of the sleeve four detent members are integrally formed thereon lying in a cross-sectional plane extending perpendicularly to the sleeve axis, that each detent member is formed by a finger which extends concentrically to the sleeve spaced from the outer surface thereof and which at one end is formed with a connecting web on the sleeve whilst its other end is formed in the manner of a fingertip and engages into one of the grooves in the outer peripheral face of the annular groove.

5. Printing mechanism according to claim 4, characterized in that the fingers are connected together in pairs at the one end and each extend over about 70° to 80° in the peripheral direction of the sleeve, two fingers of different pairs being opposite each other in spaced relationship at the fingertip-like ends.

6. Printing mechanism according to claim 5, characterized in that the sleeve is provided with two diametrically opposite slots, that on the setting shaft two drivers are disposed which project through the slots that the connecting points of the one ends of the fingers extend in the region of each slot radially spaced from the outer peripheral surface of the sleeve and bridge the respective slot and that the connecting points are spaced from the outer peripheral face of the sleeve at least as far as the driver on the setting shaft projects through the slot.

7. Printing mechanism comprising a housing, a plurality of coaxially disposed setting wheels with which type carriers carrying printing types are in drive connection and can be brought into predetermined setting positions, a setting shaft which extends through centrally disposed openings located in the hub region of the setting wheels and which is mounted rotatably and axially displaceably in a wall of the housing and at one end carries at least one driver adapted by axial displacement of the setting shaft to be brought into engagement with radial recesses disposed in the hub region of the setting wheels and which at its other end carries an actuating knob, and at least two detent means for arresting the setting wheels on rotation thereof and for holding the setting wheels in their rest position, characterized in that one detent means is in mechanical connection with at least the particular setting wheel selected and in addition at the most with the setting wheels disposed between the selected setting wheel and the other end of the setting shaft with a bush surrounding the setting shaft and connected fixed in rotation thereto is disposed and is provided at its outer peripheral face with at least one resilient detent member and in the housing wall receiving the detent bush, detent recesses associated with the setting positions of the type carriers are disposed for engagement by the at least one detent member.

8. Printing mechanism according to claim 7, characterized in that the at least one detent member is disposed on the bush in such a manner that it generates a radially outwardly directed detent force, and that the detent recesses are grooves extending axially relatively to the setting shaft in the inner face of a bore in the housing wall receiving the bush.

9. Printing mechanism according to claim 8, characterized in that at the outer peripheral face of the bush four detent members are disposed which lie in a cross-sectional plane extending perpendicularly to the axis of the setting shaft, that each detent member is formed by a finger which extends concentrically to the bush spaced from the outer surface thereof and which is formed at one end with a connecting web on the bush (142) whilst its other end is formed in fingertip manner and engages into one of the grooves in the inner face of the bore in the housing wall.

10. Printing mechanism according to claim 9, characterized in that the fingers are connected together in pairs at the one end and each extend over about 70 ° to 80° in the peripheral direction of the bush, two fingers of different pairs being opposite each other in spaced relationship at the fingertip-like ends.

11. Printing mechanism comprising a housing, a plurality of coaxially disposed setting wheels with which type carriers carrying printing types are in drive connection and can be brought into predetermined setting positions, a setting shaft which extends through centrally disposed openings located in the hub region of the setting wheels and which is mounted rotatably and axially displaceably in a wall of the housing and at one end carries at least one driver adapted by axial displacement of the setting shaft to be brought into engagement with radial recesses disposed in the hub region of the setting wheels and which at its other end carries an actuating knob, and at least two detent means for arresting the setting wheels on rotation thereof and for holding the setting wheels in their rest position, characterized in that one detent means is in mechanical connection with at least the particular setting wheel selected and in addition at the most with the setting wheels disposed between the selected setting wheel and the other end of the setting shaft and the setting shaft at the end carrying the actuating knob is axially undisplaceably in connection with a window frame which surrounds a window through which it can be seen which printing types assume a printing position, the window frame having at one end a web which carries a protected eye surrounding the setting shaft, characterized in that to form the one detent means the eye ends lying on either side of the slot of the eye are formed in fingertip manner and engage radially inwardly into grooves which are formed in the outer peripheral surface of the setting shaft surrounded by the eye at positions which are associated with the setting positions of the type carriers.

12. Printing mechanism comprising a housing, a plurality of coaxially disposed setting wheels with which type carriers carrying printing types are in drive connection and can be brought into predetermined setting positions, a setting shaft which extends through centrally disposed openings located in the hub region of the setting wheels and which is mounted rotatably and axially displaceably in a wall of the housing and at one end carries at least one driver adapted by axial displacement of the setting shaft to be brought into engagement with radial recesses disposed in the hub region of the setting wheels and which at its other end carries an actuating knob, and at least two detent means for arresting the setting wheels on rotation thereof and for holding the setting wheels in their rest position, characterized in that one detent means is in mechanical connection with at least the particular setting wheel selected and in addition at the most with the setting wheels disposed between the selected setting wheel and the other end of the setting shaft and a pin is provided which is axially displaceable with the setting shaft, extends parallel spaced from the axis thereof, is connected via a web to the end of the setting shaft carrying the actuating knob and extends from said end up to the plane which extends perpendicularly to the axis of the setting shaft and in which the at least one driver lies, characterized in that the pin (128) is spaced from the axis of setting shaft (42) a distance such that it can be brought into engagement with recesses at the outer periphery of the setting wheels (16) which are provided for establishing the drive connection between the setting wheels (16) and the type carriers (2), said pin being so formed that at least its end lying in the plane of the driver (36, 38) engages into a recess at the outer periphery of the selected setting wheel (**16*a***).

13. Printing mechanism according to claim 12, characterized in that the web connecting the pin to the setting shaft is resilient.

* * * * *